US009585475B2

(12) United States Patent
Tines

(10) Patent No.: US 9,585,475 B2
(45) Date of Patent: Mar. 7, 2017

(54) WIRE SHELF COVER PRODUCT, KIT AND METHOD

(71) Applicant: Steven M. Tines, Grover, MO (US)

(72) Inventor: Steven M. Tines, Grover, MO (US)

(73) Assignee: John Louis Inc., Earth City, MO (US)

( * ) Notice: Subject to any disclaimer, the term of this patent is extended or adjusted under 35 U.S.C. 154(b) by 0 days.

(21) Appl. No.: 14/466,066

(22) Filed: Aug. 22, 2014

(65) Prior Publication Data

US 2015/0053634 A1 Feb. 26, 2015

Related U.S. Application Data

(60) Provisional application No. 61/868,811, filed on Aug. 22, 2013.

(51) Int. Cl.

| | |
|---|---|
| ***A47F 5/00*** | (2006.01) |
| ***A47F 5/08*** | (2006.01) |
| ***A47B 96/02*** | (2006.01) |
| ***A47B 13/08*** | (2006.01) |
| ***A47B 47/04*** | (2006.01) |
| ***A47B 95/04*** | (2006.01) |
| ***A47F 5/11*** | (2006.01) |
| ***A47B 55/02*** | (2006.01) |

(52) U.S. Cl.

CPC ..... *A47B 96/02* (2013.01); *A47B 13/08* (2013.01); *A47B 13/083* (2013.01); *A47B 47/04* (2013.01); *A47B 55/02* (2013.01); *A47B 95/043* (2013.01); *A47F 5/118* (2013.01); *Y10T 29/49716* (2015.01)

(58) Field of Classification Search

CPC ..... A47B 96/02; A47B 55/02; A47B 96/021; A47B 13/08; A47B 13/06; A47B 2013/085; A47B 13/086; A47B 47/00; A47B 45/00; A47B 47/04; A47B 47/06; A47B 55/00; A47B 95/043; A47B 2095/046; A47B 13/083; A47B 43/02; A47B 55/06; Y10T 29/49716; A47F 5/0043; A47F 5/01; A47F 5/0846; A47F 5/118; A47F 3/147; A47F 2005/0075

USPC ..... 211/90.03, 183, 135, 181.1, 72, 73, 211/119.003, 153; 248/249, 250; 108/27, 108/90, 42; 428/99, 119, 191

See application file for complete search history.

(56) References Cited

U.S. PATENT DOCUMENTS

| | | | | |
|---|---|---|---|---|
| 2,599,607 A * | 6/1952 | Burrise | F25D 25/02 | 211/153 |
| 3,241,334 A * | 3/1966 | Amore | F25D 25/021 | 62/382 |
| 3,637,085 A * | 1/1972 | Ball | A47B 96/021 | 211/153 |

(Continued)

*Primary Examiner* — Jennifer E Novosad

(74) *Attorney, Agent, or Firm* — Polster, Lieder, Woodruff & Lucchesi, L.C.

(57) ABSTRACT

A method for restoring the visual appearance of a wire shelf, products employed in the method, and a kit containing the parts used for the restoration are provided for simplifying the process of altering the appearance of a wire shelf construction. The kit preferably includes a top surface covering having adjustable depth dimensions. A profile number is adapted preferably to engage in an edge of the top surface and the top surface and profile members are attached the underlying wire shelf to maintain the assembly in position.

16 Claims, 4 Drawing Sheets

(56) References Cited

U.S. PATENT DOCUMENTS 3,998,069 A * 12/1976 Kronenberger ..... F25D 17/045 211/126.15
4,606,170 A * 8/1986 Mendenhall ..... A47B 95/043 108/27
4,679,818 A * 7/1987 Kakavas ..... A47F 3/14 108/90
4,960,308 A * 10/1990 Donaghy ..... F25D 25/025 211/134
5,228,581 A * 7/1993 Palladino ..... A47F 3/0486 108/90
5,538,147 A * 7/1996 Fucci ..... A47F 5/01 108/90
5,597,077 A * 1/1997 Hartmann ..... A47F 5/0056 211/134
5,697,302 A * 12/1997 Putnam ..... A47B 55/02 108/90
6,401,945 B1 * 6/2002 Gawel ..... A47F 5/0043 108/90
6,725,785 B2 * 4/2004 Wang ..... A47B 96/021 108/90
D520,287 S * 5/2006 Sparkowski ..... D6/574
7,131,547 B2 11/2006 Gawel
7,810,440 B2 * 10/2010 Ward ..... A47B 96/021 108/161
8,511,488 B2 * 8/2013 Poisson ..... A47F 5/01 211/153
9,149,119 B2 * 10/2015 Hansel ..... A47F 5/0043
2002/0170870 A1 * 11/2002 Callis ..... A47B 96/02 211/119.003
2004/0004052 A1 * 1/2004 Young ..... A47F 5/01 211/183
2004/0020879 A1 * 2/2004 Close ..... A47F 1/12 211/59.3
2006/0180056 A1 * 8/2006 Dorholt ..... A47B 13/086 108/90
2007/0023374 A1 * 2/2007 Nawrocki ..... A47F 5/0846 211/90.01
2007/0251426 A1 * 11/2007 Li ..... A47B 55/02 108/27
2008/0017600 A1 * 1/2008 Thompson ..... A47B 96/021 211/119.003
2009/0001037 A1 * 1/2009 Wilcock ..... A47B 97/00 211/119.003
2015/0053634 A1 * 2/2015 Tines ..... A47B 55/02 211/186

* cited by examiner

WIRE SHELF COVER PRODUCT, KIT AND METHOD

CROSS-REFERENCE TO RELATED APPLICATIONS

This application claims priority to U.S. Provisional Application No. 61/868,811 filed Aug. 22, 2013, which is incorporated in its entirety by reference.

STATEMENT REGARDING FEDERALLY SPONSORED RESEARCH

Not Applicable.

BACKGROUND OF THE INVENTION

This invention relates generally to shelf coverings, and more particularly, pertains to products, kits and method of application which may be utilized by a homeowner or other installer to upgrade the finished look of wire shelving, commonly found in homes and businesses. While the disclosure is specifically described in terms of wire shelving, those skilled in the art will recognize the wider applicability of the inventive principles disclosed hereinafter.

Wire shelves are commonly used in new building construction and appear, especially, in both closets and pantries in both residential and commercial buildings. Their popularity stems from their low-cost, easy removal from the closet or pantry, for example, and their light weight. Nevertheless, a number of problems have surfaced with this type of shelf. Because of the shelf construction using cross bars, for example, clothing rested upon the shelf can assume the pattern of the cross bars over time. That result is unacceptable to users even if they are not counted among the most fastidious dressers. Additionally, when certain types of a small base and/or tall items are placed upon the shelf, the spacing between the cross bars can cause the items to fall over. The problem can be more acute when small items are stored. If the items are fragile or not closed completely, unintended spillage of any stored contents may occur.

Regardless of these problems, many users, especially homeowners, find the shells unattractive per se. A substantial industry has developed for upgrading closets and pantries, for example, in which the shelves are removed and replaced with wood or imitation wood products. While replacement products work well for their intended purposes, they normally are expensive, limiting their market to users willing to bear the expense for improved looks.

The prior art discloses a number of attempts to solve the problems associated with wire shelves. In general, these solutions merely attempt to place something along the upper boundary of the shelf surface. The wire shelves themselves, come in a number of configurations. When used in closets, besides the shelf itself, a depending bar is provided for hanging articles of clothing below the shelf. When used in pantries, the shelf construction is modified to eliminate the depending bar. I have devised a unique combination of parts, preferably sold in kit form, which enables a homeowner or installer to enhance the appearance of a wire shelf regardless of the particular construction employed for the shelf. As later described in greater detail, the parts include or are available in three different lengths and in various colors. When assembled in a preferred kit form, each kit includes a length of a larger profile molding, a length of medium profile molding, and a length of small profile molding. In addition, aluminum clips and associated fastening devices, preferably screws, are employed to permit the profile molding to be attached securely to the wire shelf. The kit also includes an expandable plywood member which enables an installer to adjust what becomes the top of the wire shelf to varying wire shelf depths such that the plywood member to be adjusted to specific shelf depths up to 20 inches. The finished product substantially improves the appearance of the wire shelf, and the final result is comparable to the more expensive custom designs available in the market.

SUMMARY

In accordance with this disclosure generally stated, a restoration product, preferably in kit form and method of installation are provided for enhancing the appearance of wire shelves. When provided in kit form, the kit is made available in varying length and width dimensions and includes a top surface covering, a profile covering and a plurality of clips for attaching the top surface and profile covering to the underlying wire shelf. The kit is designed to accommodate various widths and depths of the underlying wire shelf and the front face profile of the shelf. The installation method is simplified in that the top cover has depth dimensions provided with score lines, for example, for easy removal of material not needed for a particular application.

The foregoing and other objects, features, and advantages of the disclosure as well as presently preferred embodiments thereof will become more apparent from the reading of the following description in connection with the accompanying drawings.

BRIEF DESCRIPTION OF THE SEVERAL VIEWS OF THE DRAWINGS

In the accompanying drawings which form part of the specification.

Corresponding reference numerals indicate corresponding parts throughout the several figures of the drawings.

DESCRIPTION OF THE PREFERRED EMBODIMENT

Figure 1A:
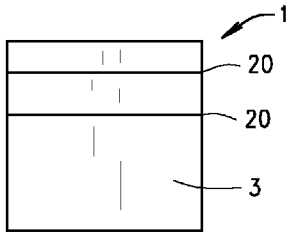
FIGS. 1A-1F are plan views partly in perspective of one illustrative embodiment of wire shelf restoration assembly of the present disclosure.
Figure 1F:
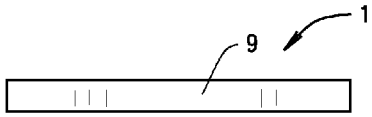

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

Referring now to FIG. 1A through 1F, reference numeral 1 indicates one illustrative embodiment of shelf cover assembly of the present disclosure. As will be appreciated by those skilled in the art, while individual components of the assembly 1 may be provided or sold separately and/or in a number of combinations, the preferred embodiment is in the form of an all-inclusive package or kit that is universally applicable to the majority of wire shelf systems available and/or installed in many businesses and homes. As illustratively shown in FIG. 1A-1F, the assembly 1 includes a shelf panel or top cover 3; a plurality of profile or shelf rail covers 6, 7 and 8; an adhesive substance in the form of double sided adhesive tape; a series of fasteners 10 and 11; at least one clip 12; and a spacer 13. The specific count of the various components of the assembly may vary, as may the specific aesthetic composition of the various components.

As will be appreciated, commonly available or typical wire shelf products include a top support 15 and a front rail or profile 16. The particular details for typical wire shelf construction are not described in detail, but the shelves themselves have become nearly ubiquitous in the construction industry. While as indicated the particular details of the shelves may vary somewhat, the most common forms have a front profile or front rails commonly having a height dimension of 1 inch, 2 inches, and 2½ inches. Likewise, the shelves themselves commonly have a depth dimension of 12, 16 or 20 inches.

Figure 1B:
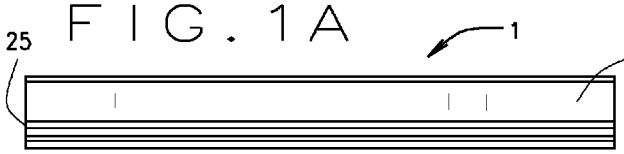
Figure 1C:
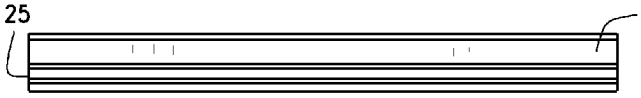
Figure 1D:
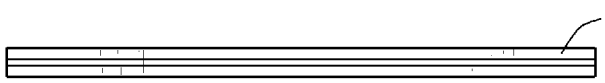
Figure 1E:
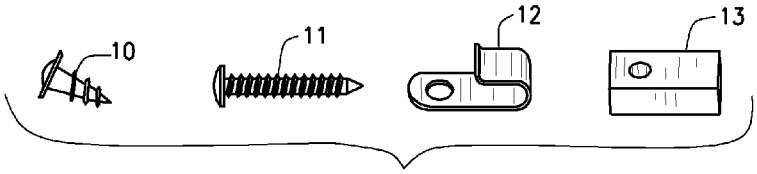
Figure 2A:
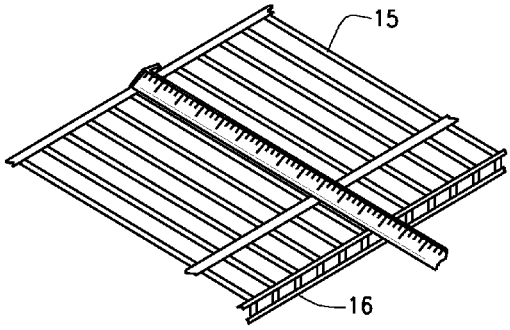
FIGS. 2A-2B are views partly in perspective of an initial installation step for the assembly of FIG. 1.
Figure 2B:
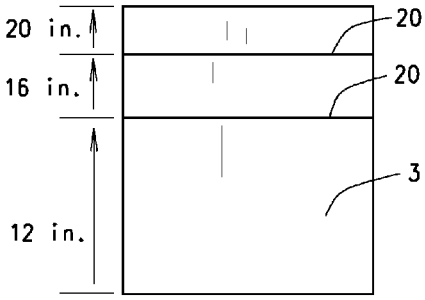
Figure 3A:
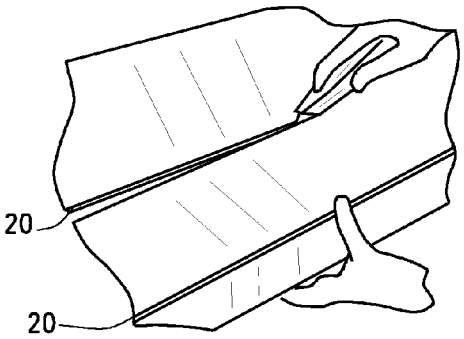
FIGS. 3A-3B are views in perspective of a second installation step for the assembly of FIG. 1.
Figure 3B:
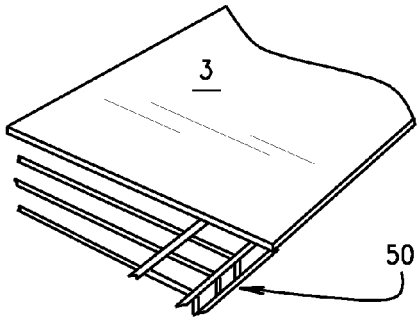
Figure 4A:
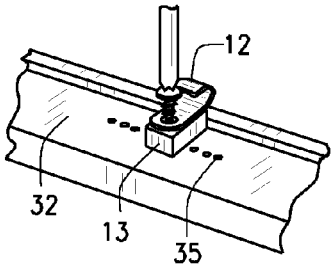
FIGS. 4A-4B are views in perspective of a third installation step for the assembly of FIG. 1.
Figure 4B:
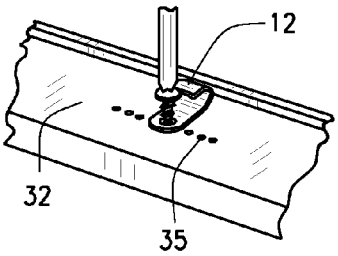

In order to accommodate the variations in the wire shelves commonly in use, I have provided the top cover 3 with score lines 20 for shelf depths of 12, 16 and 20 inches respectively. The score lines are used to adjust the shelf cover depth to the respective depth of the associated shelf. The profile or rail covers also are provided, in three depth sizes to cover the most common shelf rails found in the market. The profile or shelf rails themselves may be decorated and/ or have other esthetic considerations and/or decorations associated with them. For example, one form of such decorations are shown in FIGS. 1B and 1C and identified by reference numeral 25.

The shelf cover 3 preferably is constructed from wood, although those skilled in the art will recognize that other materials may be employed, if desired. Because of the variations in wire shelf constructions, I prefer to sell the shelf cover assembly of the present disclosure in kit form. However, again as will be appreciated by those skilled in the art, individual components or various combinations of the kit components may be sold separately, if desired. In kit form, the assembly 1 further includes a predetermined length of double sided adhesive panel tape or other suitable adhesive material, and associated screw 10 and 11, clips 12 and spacers 13 for purposes described more fully hereinafter.

Because of the variations in wire shelf constructions and configurations, the method of use for the products described above also is described with respect to each of the shelf depths and/or profile depths available. In utilization of the assembly 1 of the present disclosure, the first step, regardless of shelf depth is to measure the depth of the shelf. As indicated, the shelf top cover 3 has pre scores 20 associated with it at 12 16, 20 inch shelf depths. In utilizing the assembly, the shelf depth is measured and once determined, the cover 3 is cut along the appropriate score line 20 for the required shelf depth. As will be appreciated, if a shelf depth is less than the panel's predetermined depths for the top cover 3, a smaller cover depth can be cut with a conventional saw. Excess material may be discarded, but preferably is placed on the wire shelf to support the cover for purposes described below.

The assembly of the rail or profile covers 6, 7 having depth dimensions of 2 inches and 2½ inches respectively are similar to one another. The correct or desired shelf rail profile depth is determined by the depth of the front face on the wire shelf. Each the profiles 6 and 7 have a front face 30 and a rear face 32 separated by a material thickness 33 of material from which the respective profiles are constructed. The rear face 32 of the profiles 6 and 7 have a plurality of pre-drilled pilot holes 35 formed in them sized to accept one of the fasteners 10 or 11 depending on the wire shelf construction. The fasteners 10 or 11 are used to attach the clip 12 to the respective profile covers 6 and 7. The plot hole 35 used is determined so that the clip 12 aligns between shelf wires and the process is repeated for each group of pilot holes formed in the respective covers 6 and 7. Certain wire shelf constructions may require the use of the spacer 13 to mount the clip 12 to the profile cover.

Figure 5A:
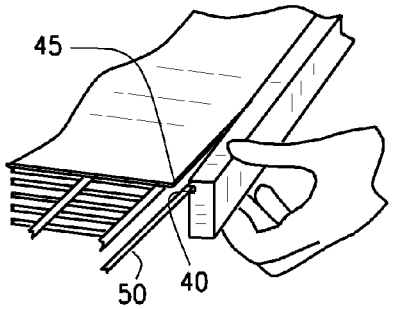
FIGS. 5A-5B are views in perspective of a fourth installation step for the assembly of FIG. 1.
Figure 5B:
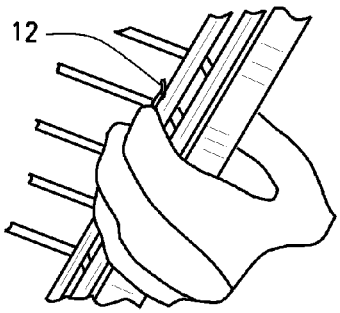
Figure 8:
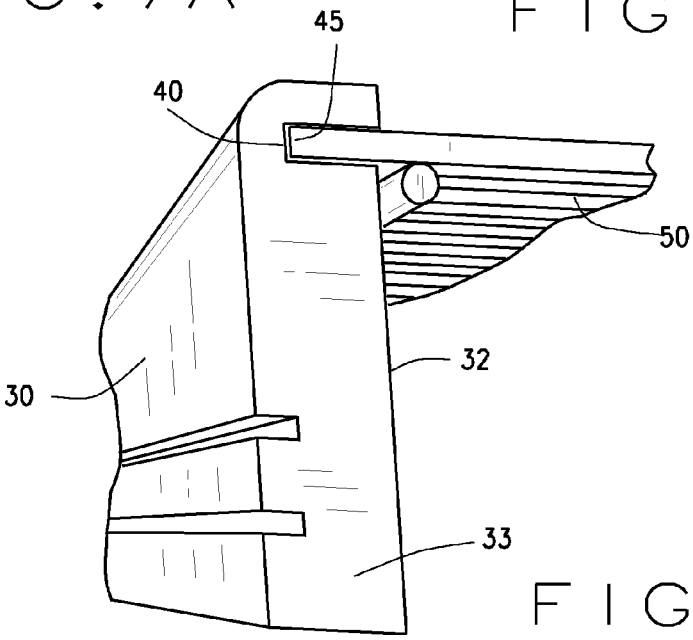
FIG. 8 is a view in perspective of one illustrative embodiment corresponding to FIG. 5 following installation.

As indicated in FIGS. 5A and 8, the side rail or profile covers 6 and 7 have a channel 40 formed in them sized to receive an edge of the shelf cover 3. During installation, the edge of the shelf top cover 3 is inserted in the channel 40 of the respective profile cover 6 and 7 and the pre located clips 12 are placed over portions of the wire shelf 50 to attach the assembly to the underling wire shelf 50 as illustratively shown in FIGS. 5A and 5B.

Figure 6A:
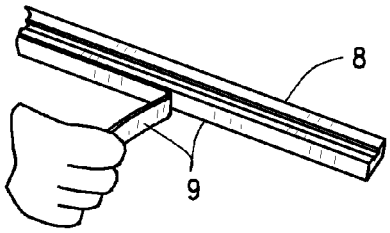
FIGS. 6A-6B are views in perspective of illustrative alternative installation steps for the assembly of FIG. 1.
Figure 6B:
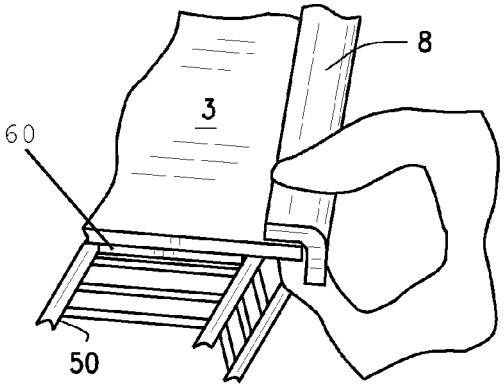
Figure 7A:
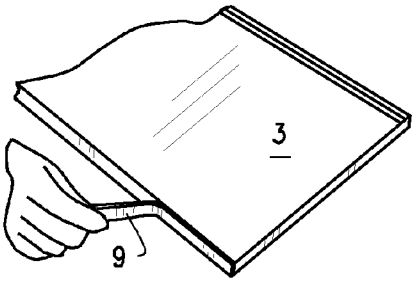
FIGS. 7A-7B are views in perspective of illustrative second alternative installation steps for the assembly method shown in FIGS. 6A-6B.
Figure 7B:
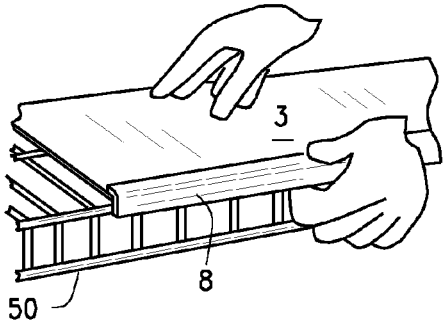

In installations where the shelf rail front profile is approximately 1 inch or less, the installation procedure is modified to accommodate the smaller depth of the shelf profile. As shown in FIG. 6B, the profile generally is "L" shaped in cross section. In this situation, the double sided tape 9 is utilized to attach the shelf profile 8 to the top shelf panel 3 directly. In addition, the shelf panel 3 is attached at its opposite end, along the underside of that panel 3, to the underlying wire shelf 50. The tape 9, or other adhesive material, is used to secure the assembly. The procedure is illustrated in FIGS. 6 and FIGS. 7. In addition, excess material 60 from the shelf cover 3 may be placed on the wire shelf 50 to support the assembly in application use.

Figure 9A:
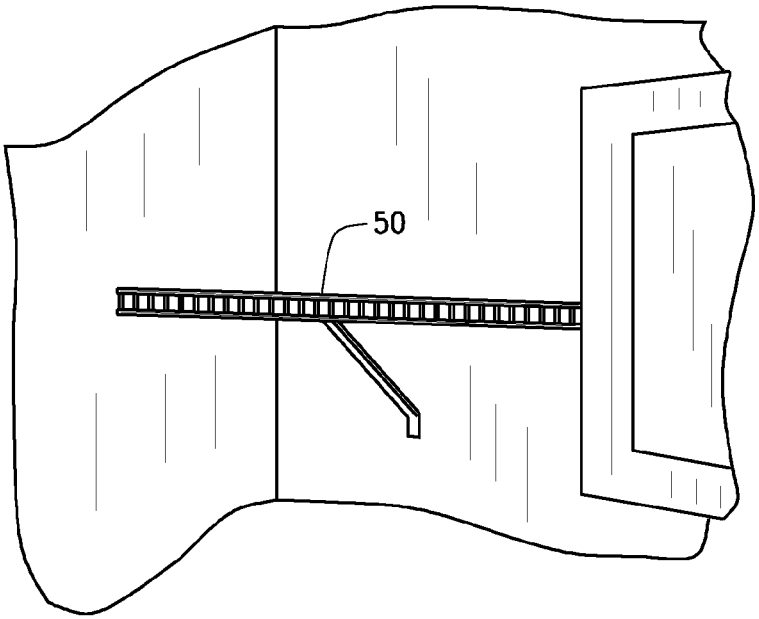
FIGS. 9A and 9B are views in perspective of a before and after installation using the assembly of the present disclosure.
Figure 9B:
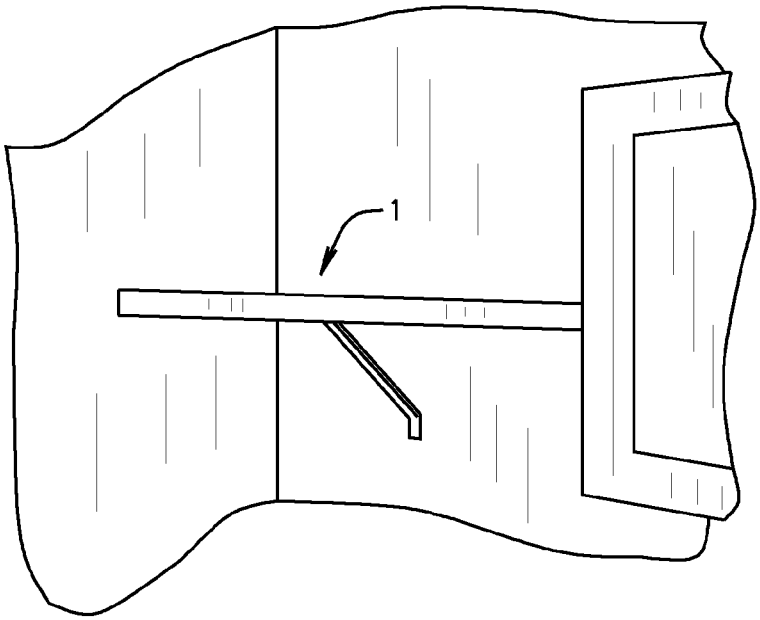

Use of the assembly 1 dramatically enhances the visual appearance of common wire shelves 50. That difference is illustrated in FIGS. 9A and 9B. The assembly 1 gives a substantial upgrade appearance after installation and does so at reasonable cost.

The method of the present disclosure may be summarized with respect to each of the three shelf rail sizes included within the product line is as follows. First, the shelf cover 3 sized depth of the shelf in question is determined. Score lines are provided to the installer to cut away excess material. When the shelf profile rail is 2 to 2½ inches in depth, the associated shelf rail cover 6 or 7 is chosen, and an edge of shelf panel 3 is inserted into the channel 40 formed in the respective shelf rail. Prior to that attachment, the clips 12 are attached to the shelf rail in predetermined locations. The shelf panel 3 is inserted in the channel 40, and the clips 12 are placed on the wire shelf and closed over the wire shelf 50 to complete the assembly.

For smaller profiles, the cover profile 8 is mounted to the shelf panel 3 through the use of suitable tape 9, for example. The tape 9 is attached to the shelf rail profile 8, and shelf rail profile 8 then is attached directly to the panel 3 itself. Installation is completed by further attaching tape 9 to the opposite end of the panel 3 underside, and the panel 3 is placed in position and pressed firmly to secure the assembly to the wire shelf 50.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense. Merely by way of example and not of limitation, other adhesive or attachment devices besides double sided tape, clips or screws may be used if desired. Hook and loop fastening devices also work, for example. Particular length and depth dimensions may vary in other embodiments. While wood is preferred for the components of the assembly, other materials may be employed, if desired. These variations are merely illustrative.

What is claimed is:

1. A method for wire shelf restoring by upgrading and changing the visual appearance of an associated wire shelf, the wire shelf having a top surface and front face, the top surface and front face each having fixed length and depth dimensions, comprising:

providing a top surface covering for the associated wire shelf, the top surface covering having a plurality of depth selectable dimensions associated with it;

permanently altering the depth selectable dimensions of the top surface covering to correspond to the fixed depth dimension of the associated wire shelf;

providing a front profile, the profile having a depth dimension defined by a first back face surface and a second front face surface, the back face surface having a slot formed in the back surface of the front profile for receiving an edge of the top surface covering, the front profile being sized to hide the front face of the associated wire shelf and the top surface covering adapted to hide the top surface of the associated wire shelf;

securing a plurality of clips to the front profile;

mounting the front profile to the top surface covering along the slot in the back surface of the front profile; and attaching the plurality of clips of the front profile to the associated wire shelf to hold the front profile and top surface covering in position on the associated wire shelf.

2. The method of claim 1 wherein the top surface covering has a plurality of score lines formed in the covering.

3. The method of claim 2 wherein the front profile is wood.

4. The method of claim 3 wherein the top surface covering is wood.

5. The method of claim 2 wherein the top surface covering and the profile have wood finishes associated with them.

6. An assembly for covering an associated wire shelf, the associated wire shelf having a fixed width dimension and a fixed depth dimension, and a front face, the assembly comprising:

a solid top surface cover having a preselected color finish, the top surface cover having a width dimension corresponding to the width dimension of the associated wire shelf and a plurality of selectable depth dimensions, at least one of the plurality of depth dimensions corresponds to the fixed depth dimension of the associated wire shelf;

a profile attachable to the top surface cover, the profile having a depth dimension defined by a first back profile face surface and a second front profile face surface, the front profile face surface sized to hide the front face of the wire shelf, the profile having a preselected color finish;

a first attachment mechanism for attaching the profile to the top surface cover along the back surface of the profile; and a second attachment mechanism for attaching at least one of the profile and the top surface cover to the wire shelf, at least one of the first and second attachment mechanisms being secured between and to the profile and the associated wire shelf.

7. The assembly of claim 6 wherein the color finish is a wood grain.

8. The assembly of claim 7 wherein the first attachment mechanism is a groove formed in the profile sized to receive an edge of the top surface cover.

9. The assembly of claim 8 wherein the second attachment mechanism is a clip secured to the profile and attached between the profile and the associated wire shelf.

10. The assembly of claim 9 further including a plurality of spacers for modifying a position of at least one clip with respect to the wire shelf, the clip and its corresponding spacer being attached to one another, the clip being attached to and between the profile and the associated wire shelf.

11. The assembly of claim 6 wherein the first attachment mechanism is an adhesive substance associated with the profile and the top cover.

12. The assembly of claim 11 wherein the second attachment mechanism is an adhesive substance associated with the top cover and the wire shelf.

13. The assembly of claim 6 wherein the first attachment mechanism and second attachment mechanism is double sided tape.

14. The assembly of claim 6 wherein the top cover has a plurality of score lines formed in it to define a plurality of selectable depth dimensions for the top cover, at least one of said selectable depth dimensions corresponding to the fixed depth dimension of the associated wire shelf.

15. The assembly of claim 6 wherein the profile is wood.

16. The assembly of claim 15 wherein the top cover is wood.

* * * * *